US008610571B1

(12) United States Patent
Solieri

(10) Patent No.: US 8,610,571 B1
(45) Date of Patent: Dec. 17, 2013

(54) WINDOW ALARM DEVICE

(76) Inventor: Anthony E. Solieri, Yonkers, NY (US)

( * ) Notice: Subject to any disclaimer, the term of this patent is extended or adjusted under 35 U.S.C. 154(b) by 71 days.

(21) Appl. No.: 13/450,310

(22) Filed: Apr. 18, 2012

(51) Int. Cl.
*G08B 13/08* (2006.01)

(52) U.S. Cl.
USPC ..... 340/545.1; 340/545.2

(58) Field of Classification Search
USPC ..... 340/545.1, 545.2
See application file for complete search history.

(56) References Cited

U.S. PATENT DOCUMENTS 4,151,382 A * 4/1979 Kaufman et al. ..... 200/61.71
4,225,857 A 9/1980 Frank
4,346,372 A 8/1982 Sandberg
4,677,424 A * 6/1987 Hollinger ..... 340/547

* cited by examiner

*Primary Examiner* — Travis Hunnings

(57) ABSTRACT

The window alarm device provides an electronic receiver, a control panel within the receiver, an audio output disposed within the receiver, a video screen disposed within the receiver, a plurality of electronic transmitters, each transmitter further comprising an individual electronic identification, an electrical sensor port disposed within each transmitter, a plurality of activation strips, each having a front spaced apart from an adhesive back, the front further comprising, a plurality of valleys, a ridge disposed between an any two adjacent valleys, a smooth transition connecting each valley to each ridge, a sensor extended from each transmitter, each sensor further comprising, a vertical leg, a pivotal leg pivotally affixed atop the vertical leg, the pivotal leg frictionally positioned, and a point disposed at a distal end of the pivotal leg, the point configured to follow the activation strip front.

4 Claims, 3 Drawing Sheets

WINDOW ALARM DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present window alarm device detects window movement and thereby triggers a remotely located alarm. The device negates the use of contact breakers and magnetic breakers and the like which are sometimes unreliable and which must be located predictably. The effectiveness of previous alarms devices can be negated by magnetic interference, another problem solved by the present device.

FIELD OF THE INVENTION

The window alarm device relates to security alarm devices and more especially to an alarm device that is especially useful in detecting sliding window movement.

SUMMARY OF THE INVENTION

The general purpose of the window alarm device, described subsequently in greater detail, is to provide a window alarm device which has many novel features that result in an improved window alarm device which is not anticipated, rendered obvious, suggested, or even implied by prior art, either alone or in combination thereof.

To attain this, the window alarm device provides for positive mechanical and electronic sensing of a portal movement, such as that of a sliding window. A key feature of the device is the lack of magnetic contacts and the negation of magnetic influences on the device. One of the activation strips may be placed on any sliding window, for example, and located substantially where desired. One of the transmitters is then placed on a stationary surface proximal to the activation strip. One sensor may be plugged into each transmitter and is then pivotally adjusted to interact with the activation strip. Sensors may also be included permanently in the transmitters. The valleys and ridges of the activation strip detect movement of a sensor by way of the sensor sensing the movement via the sensor point. It is important to note the smooth transition between valleys and ridges so that the sensor point may easily follow the activation strip. Smooth strip follow further ensures the frictionally maintained relationship for the vertical and pivotal leg of each sensor. The point may be rubberized. The point and the transmitter are in electronic communication. Each transmitter has an individual electronic signal for transmission to the electronic receiver. The electronic receiver emits sound via the audio output. The video screen is able to tell an operator which transmitter has triggered the alarm. The control panel of the receiver is capable of numerous functions, such as but not limited to displaying transmitter individual identification, setting alarm output volume, initiating alarm capability, and turning off individual alarms and the cumulative system.

Thus has been broadly outlined the more important features of the improved window alarm device so that the detailed description thereof that follows may be better understood and in order that the present contribution to the art may be better appreciated.

An object of the window alarm device is to provide movement detection for a sliding portal, such as a window.

Another object of the window alarm device is to convert portal movement detection into an audio alarm.

A further object of the window alarm device is to negate magnetic operation and interference with alarm detection and function.

An added object of the window alarm device is to provide for installing in a plurality of positions on and around a portal.

And, an object of the window alarm device is to provide for visual and audio alarm for a plurality of portals.

Still another object of the window alarm device is to provide visual identification of triggered alarm portal.

These together with additional objects, features and advantages of the improved window alarm device will be readily apparent to those of ordinary skill in the art upon reading the following detailed description of presently preferred, but nonetheless illustrative, embodiments of the improved window alarm device when taken in conjunction with the accompanying drawings.

DETAILED DESCRIPTION OF THE DRAWINGS

With reference now to the drawings, and in particular FIGS. 1 through 4 thereof, the principles and concepts of the window alarm device generally designated by the reference number 10 will be described.

Figure 1:
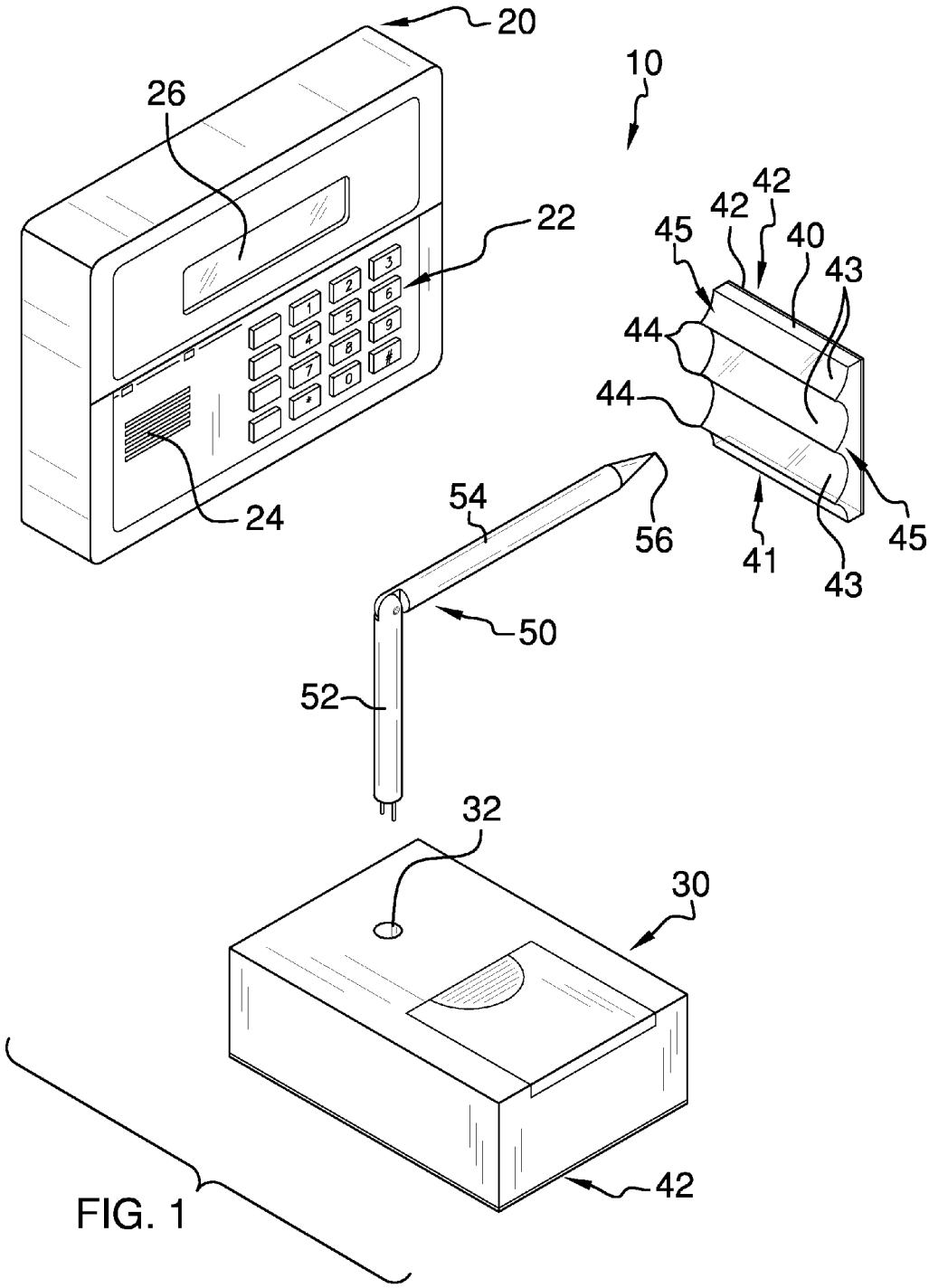
FIG. 1 is a perspective view.

Referring to FIG. 1, the device 10 partially comprises an electronic receiver 20. The receiver 20 features a control panel 22 for communicating with the plurality of transmitters 30. An audio output 24 is disposed within the receiver 20. A video screen 26 is disposed within the receiver 20. A plurality of electronic transmitters 30 is provided. Each transmitter 30 further comprises an individual electronic identification for transmission to the receiver 20.

Figure 3:
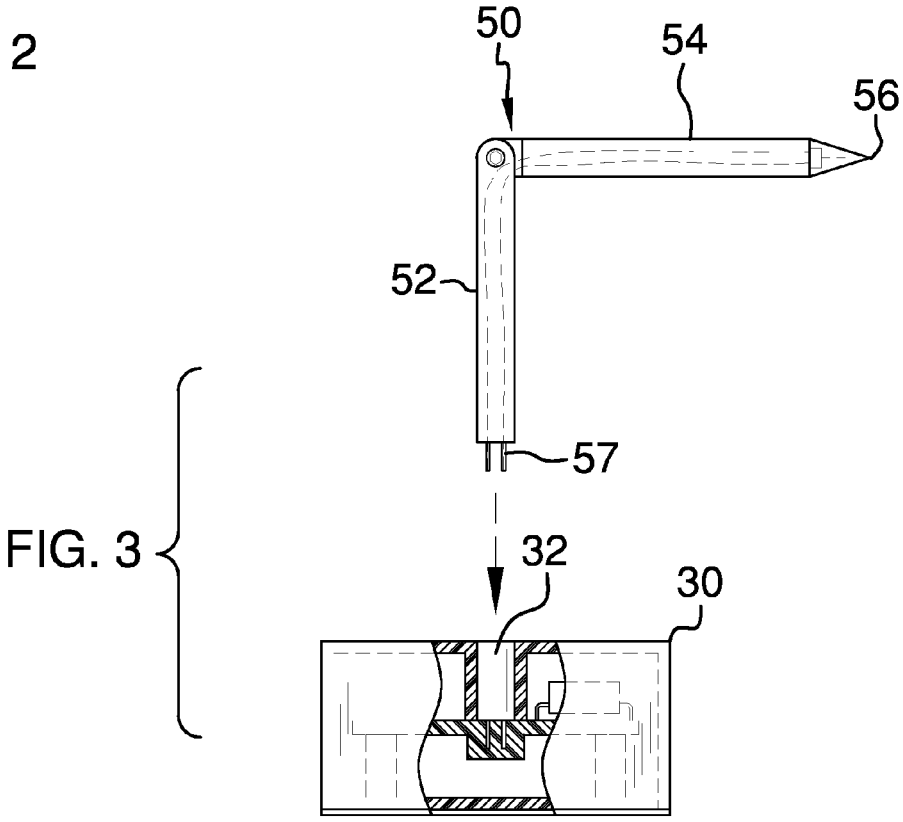
FIG. 3 is a lateral, partial cross sectional view of the transmitter and the sensor.
Figure 4:
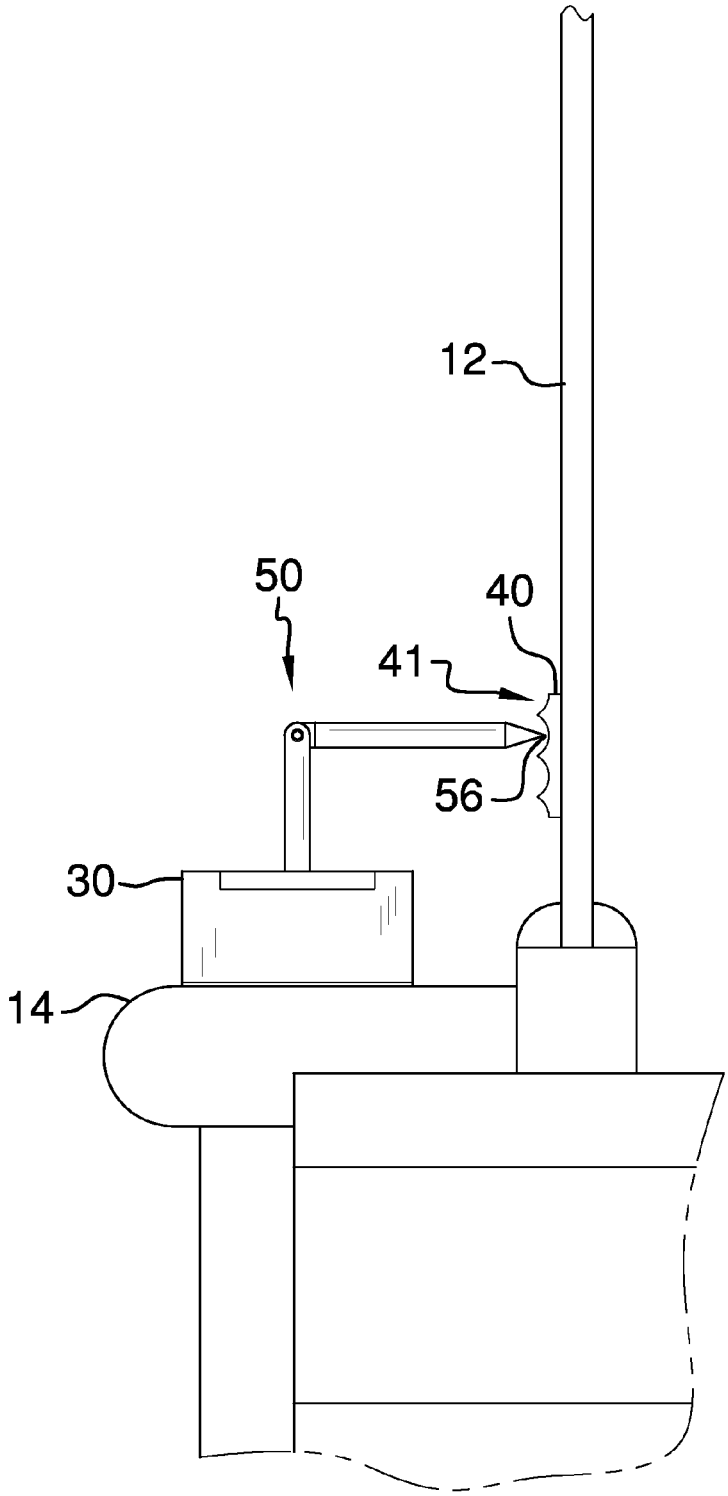
FIG. 4 is a lateral in-use view.

Referring to FIG. 3, an electrical sensor port 32 is disposed within each transmitter 30.

Figure 2:
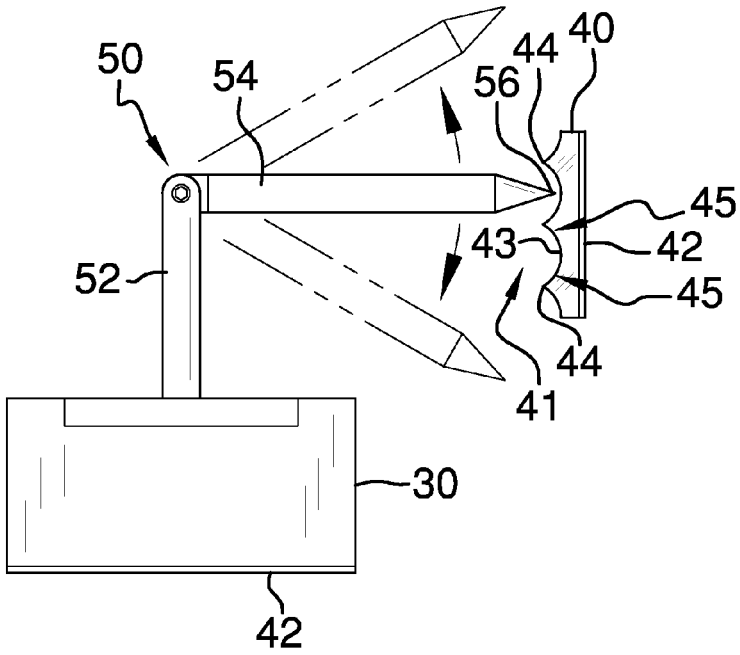
FIG. 2 is a lateral elevation view of the transmitter with sensor and activation strip.

Referring to FIG. 2, a plurality of activation strips 40 is provided. Each activation strip has a front 41 spaced apart from an adhesive back 42. The front 41 further comprises a plurality of spaced apart valleys 43. A ridge 44 is disposed between an any two adjacent valleys 43. A smooth transition 45 connects each valley 43 to each ridge 44.

Referring to FIG. 3, a plurality of sensors 50 is provided. One sensor 50 is removably plugged into one of the electronic transmitter's 30 electrical sensor port 32. Each sensor 50 further comprises a vertical leg 52 partially and removably plugged into any sensor port 32. A pivotal leg 54 is pivotally affixed atop the vertical leg 52. The pivotal leg 54 is frictionally positioned in relation to the vertical leg 52 so that relative position of the legs is retained until changed by a user. A point 56 is disposed at a distal end of the pivotal leg 54. The point 56 is configured to follow the activation strip 40 front 41.

Referring to FIG. 4 and again to FIG. 1, a window 12 and sill 14 are exemplified in explanation of device 10 operation. The activation strip 40 is affixed to the window. The transmitter 30 is affixed to the sill 14, with the sensor 50 point 56 positioned in communication with one of the valleys 43 of the activation strip 40 front 41. Any movement of one of the sensors 50 across one of the activation strips 40 activates the related transmitter 30 to signal the electronic receiver 20. The receiver 20 provides for an audio alarm from the audio output 24 and a visual display on the video screen 26. The visual display identifies which transmitter 30 signals.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the window alarm device may be used.

What is claimed is:

1. A window alarm device comprising, in combination:
an electronic receiver;
a control panel within the receiver;
an audio output disposed within the receiver;
a video screen disposed within the receiver;
a plurality of electronic transmitters, each transmitter further comprising an individual electronic identification;
an electrical sensor port disposed within each transmitter;
a plurality of activation strips, each having a front spaced apart from an adhesive back, the front further comprising:
a plurality of valleys;
a ridge disposed between an any two adjacent valleys;
a smooth transition connecting each valley to each ridge;
a sensor extended from each transmitter, each sensor further comprising:
a vertical leg;
a pivotal leg pivotally affixed atop the vertical leg, the pivotal leg frictionally positioned;
a point disposed at a distal end of the pivotal leg, the point configured to follow the activation strip front;
whereby any movement of one of the sensors across one of the activation strips activates a related transmitter to signal the electronic receiver, the receiver providing for an audio alarm from the audio output, and a visual display with transmitter identification on the video screen.

2. The device according to claim 1 further comprising a rubberized sensor point.

3. A window alarm device comprising, in combination:
an electronic receiver;
a control panel within the receiver;
an audio output disposed within the receiver;
a video screen disposed within the receiver;
a plurality of electronic transmitters, each transmitter further comprising an individual electronic identification;
an electrical sensor port disposed within each transmitter;
a plurality of activation strips, each having a front spaced apart from an adhesive back, the front further comprising:
a plurality of valleys;
a ridge disposed between an any two adjacent valleys;
a smooth transition connecting each valley to each ridge;
a plurality of sensors, one of each sensor removably plugged into one of each of the electronic transmitter electrical sensor ports, each sensor further comprising:
a vertical leg partially and removably plugged into any sensor port;
a pivotal leg pivotally affixed atop the vertical leg, the pivotal leg frictionally positioned;
a point disposed at a distal end of the pivotal leg, the point configured to follow the activation strip front;
whereby any movement of one of the sensors across one of the activation strips activates a related transmitter to signal the electronic receiver, the receiver providing for an audio alarm from the audio output, and a visual display with transmitter identification on the video screen.

4. The device according to claim 3 further comprising a rubberized sensor point.

* * * * *